US005755986A

United States Patent [19]

Yamamoto et al.

[11] Patent Number: 5,755,986

[45] Date of Patent: May 26, 1998

[54] SOFT-MAGNETIC DIELECTRIC HIGH-FREQUENCY COMPOSITE MATERIAL AND METHOD FOR MAKING THE SAME

[75] Inventors: Yutaka Yamamoto; Takao Mizushima; Akihiro Makino; Takashi Hatanai, all of Niigata-ken; Teruyoshi Kubokawa, Fukushima-ken, all of Japan

[73] Assignee: Alps Electric Co., Ltd., Tokyo, Japan

[21] Appl. No.: 717,538

[22] Filed: Sep. 19, 1996

[30] Foreign Application Priority Data

Sep. 25, 1995 [JP] Japan ..... 7-246516

[51] Int. Cl.[6] ..... H01F 1/28; H01F 1/24; H01F 1/147

[52] U.S. Cl. ..... 252/62.54; 252/62.55; 148/100; 148/101; 148/102

[58] Field of Search ..... 252/62.54, 62.55; 148/100, 101, 102

[56] References Cited

U.S. PATENT DOCUMENTS 4,689,163 8/1987 Yamashita et al. ..... 252/62.55
4,985,089 1/1991 Yoshizawa et al. ..... 148/303
5,051,200 9/1991 Srail et al. ..... 252/62.55
5,129,963 7/1992 Panchanathan et al. ..... 148/101

FOREIGN PATENT DOCUMENTS 6-61025 3/1994 Japan ..... 252/62.55

*Primary Examiner*—Melissa Bonner
*Attorney, Agent, or Firm*—Guy W. Shoup

[57] ABSTRACT

A high-frequency composite material, having soft magnetic and dielectric characteristics, comprising a soft magnetic alloy powder represented by the general composition $A_aM_bD_c$ and a synthetic resin, wherein A represents at least one element or mixture thereof selected from the group consisting of Fe, Co and Ni; M represents at least one element or mixture thereof selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements; D represents at least one element or mixture thereof selected from the group consisting of O, C, N and B; and the suffixes a, b, and c in the general formula $A_aM_bD_c$ satisfy the following equations represented by atomic percent: $40 \leqq a < 80$, $0 \leqq b \leqq 30$, and $0 < c \leqq 50$.

9 Claims, 11 Drawing Sheets

SOFT-MAGNETIC DIELECTRIC HIGH-FREQUENCY COMPOSITE MATERIAL AND METHOD FOR MAKING THE SAME

BACKGROUND OF THE INVENTION

1. Field of the Invention

The present invention relates a high-frequency composite material having both soft magnetic and dielectric characteristics and a method for making the same, which is preferably used in applied magnetic fields, such as antennas for liquid crystal (hereinafter LC) televisions, magnetic head cores, magnetic cores of pulse motors and choke coils, and transformers.

2. Description of the Related Art

Recently, the inductor in power transformers and the like has tended toward a higher driving frequency to satisfy demands on the miniaturization and higher performance of electronic devices. In response to such demands, magnetic materials having higher specific resistance, as well as soft magnetism, have been required.

Present inventors have found alloys exhibiting a high specific resistance and excellent magnetic characteristics, such as an Fe—Hf—O or Fe—Ta—O alloy in which Fe-base crystal and Hf or Ta amorphous are present together, and an $Fe_aM_bO_c$ alloy disclosed in U.S. patent application Ser. No. 08/201,831, wherein M represents at least one rare earth element and a mixture of rare earth elements. Because these soft magnetic alloys are, however, obtained as thin films by sputtering, rod objects, such as LC television antennas, magnetic head cores, and magnetic cores of pulse motors are not readily available from the alloys.

In Ni ferrite, which has been used at the highest frequency among conventional magnetic materials, Q exhibiting loss characteristics of the core material rapidly decreases at a frequency exceeding 150 MHz, so the magnetic core loss increases. In magnetoplumpite-type ferrite which has been developed for high-frequency magnetic materials, Q=1 at 1 GHz, and thus the loss is unsatisfactory at a high-frequency region of a few hundred MHz where Q is the reciprocal of the loss coefficient (tanδ) and a material exhibiting a larger Q represents a more excellent high-frequency characteristics.

Additionally, the magnetic material must be provided with dielectric characteristics when using a frequency exceeding a few hundred MHz.

The present inventors have attempted to disperse by mixing alloy powder having excellent soft magnetic characteristics into a synthetic resin having a small dielectric loss and then to form the mixture into a desirable shape in consideration of the application to LC television antennas, magnetic head cores, and magnetic cores of pulse motors.

SUMMARY OF THE INVENTION

It is an object of the present invention to solve the above-mentioned drawbacks, and to provide a high-frequency composite material having both excellent soft magnetism and low dielectric characteristics at a high frequency and being capable of readily forming a desired shape, and a method for making the same.

A high-frequency composite material having soft magnetic and dielectric characteristics in accordance with the present invention comprises a soft magnetic alloy powder represented by the general composition $A_aM_bD_c$ and a synthetic resin, wherein A represents at least one element or mixture thereof selected from the group consisting of Fe, Co and Ni, M represents at least one element or mixture thereof selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements, and D represents at least one element or mixture thereof selected from the group consisting of O, C, N and B.

Preferably, in the soft magnetic alloy powder having the general formula $A_aM_bD_c$ in accordance with the present invention, the suffixes a, b, and c in the general formula satisfy the following equations represented by atomic percent:

$40 \leqq a \leqq 80$, $0 \leqq b \leqq 30$, and $0 < c \leqq 50$.

A method for making a high-frequency composite material having soft magnetic and dielectric characteristics in accordance with the present invention comprises: forming a soft magnetic alloy powder having the general formula $A_aM_bD_c$ set forth above by a mechanical alloying process comprising mixing by grinding and stirring a powder A selected from the simple substance, oxide, carbide, carbonate, nitride and boride of at least one element selected from the group consisting of Fe, Co and Ni, and a powder M selected from the simple substance, oxide, carbide, carbonate, nitride and boride of at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements, in an atmosphere of a gas D selected from the simple substance gas, oxide gas and carbonate gas of at least one element selected from the group consisting of O, C and N, or of a gaseous mixture of the gas D and inert gas; dispersing to mix the soft magnetic alloy powder into a synthetic resin; and molding the mixture into the high-frequency composite material.

Another method for making a high-frequency composite material having soft magnetic and dielectric characteristics in accordance with the present invention comprises: forming a soft magnetic alloy powder having the general formula $A_aM_bD_c$ set forth above by a mechanical alloying process comprising mixing by grinding and stirring a powder A selected from the simple substance, oxide, carbide, carbonate and nitride of at least one element selected from the group consisting of Fe, Co and Ni, a powder M selected from the simple substance, oxide, carbide, carbonate and nitride of at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb and Bi, and a powder D comprising at least one element selected from the group consisting of C and B; dispersing to mix the soft magnetic alloy powder into a synthetic resin; and molding the mixture into the high-frequency composite material.

In the method for making a high-frequency composite material set forth above, the soft magnetic alloy powder having the general formula $A_aM_bD_c$ set forth above is formed by the mechanical alloying process, preferably in an atmosphere of a gas D selected from the simple substance gas, oxide gas and carbonate gas of at least one element selected from the group consisting of O, C and N, or of a gaseous mixture of the gas D and inert gas.

In the methods set forth above, a ground powder of an A—M alloy ribbon obtained by a liquid quenching method is used instead of the powder A and powder M.

In addition, in the method set forth above, the ground powder of an A—M alloy ribbon obtained by a liquid quenching method is also used when the soft magnetic alloy powder having the general formula $A_aM_bD_c$ is formed by the mechanical alloying method.

Further, in the method set forth above, an insulation layer is formed on the surface of the soft magnetic alloy powder having the general formula $A_aM_bD_c$ by annealing the soft magnetic alloy powder in an atmosphere selected from air, oxygen, nitrogen, water vapor and their mixture, before dispersing to mix the powder into the synthetic resin.

DESCRIPTION OF THE PREFERRED EMBODIMENTS

Figure 1:
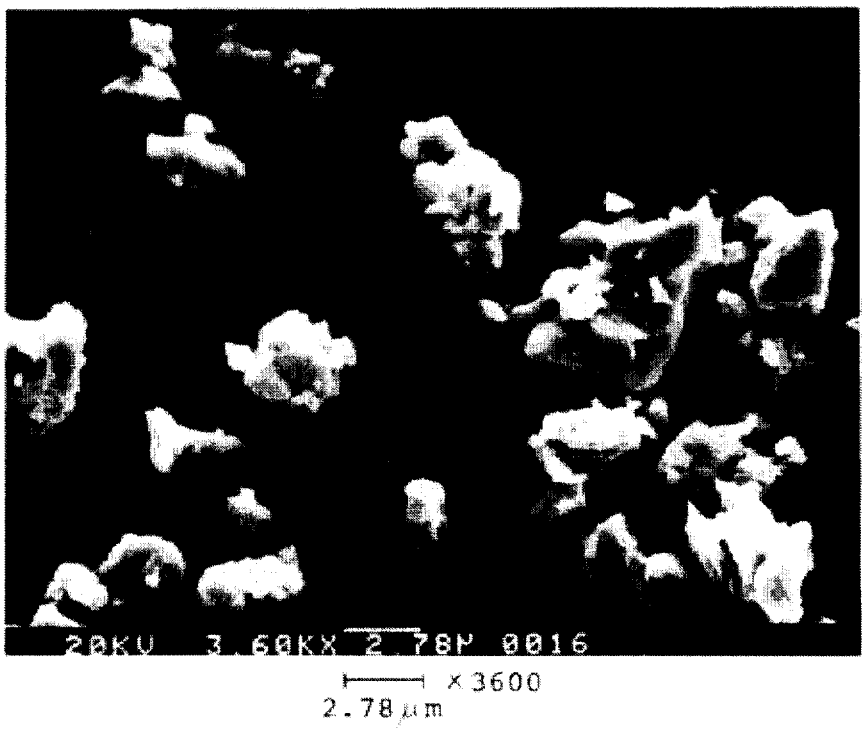
FIG. 1 is an electron microscopic photograph illustrating the particle structure of the $Fe_aZr_bO_c$ powder obtained in Example 1.

A first embodiment of a method for making a high-frequency composite material having soft magnetic and dielectric characteristics in accordance with the present invention will be explained below.

First, each raw material is weighed in response to the composition of the soft magnetic alloy powder having the general formula $A_aM_bD_c$. As raw materials, the powder A and powder M are used.

The powder A includes powders selected from the simple substance, oxide, carbide, carbonate, nitride and boride of at least one element selected from the group consisting of Fe, Co and Ni. The powder M includes powders selected from the simple substance, oxide, carbide, carbonate, nitride and boride of at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements. The rare earth elements include at least one element selected from the group consisting of Group 3A elements in the Periodic Table, such as Sc and Y, and lanthanoid elements, such as La, Ce, Pr, Nd, Pm, Sm, Eu, Gd, Tb, Dy, Ho, Er, Tm, Yb and Lu, and a mixture thereof. The size of each powder grain is preferably 100 μm or less for the powder A and 2 μm or less for the powder M, respectively.

Next, when gaseous O, C or N is added as the component D, the powder A and the powder M are placed into a stainless steel pot with stainless steel balls having the same composition as the pot, and then the pot is filled with the gas D selected from the simple substance gas, oxide gas and carbonate gas of at least one element selected from the group consisting of O, C and N. The contents in the pot are ground and stirred with a high energy planetary ball mill at a predetermined time. Such a mechanical alloying process can form the soft magnetic alloy powder having the general formula $A_aM_bD_c$, wherein A represents at least one element selected from the group consisting of Fe, Co and Ni, M represents at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements, D represents at least one element selected from the group consisting of O, C, N and B, and the suffixes a, b, and c in the general formula satisfy the following equations represented by atomic percent: $40 \leqq a \leqq 80$, $0 \leqq b \leqq 30$, and $0 < c \leqq 50$.

The time for the mechanical alloying process is preferably 2 hours or more, and more preferably 8 to 60 hours. When the time is less than 2 hours, the (bcc) crystal of the powder A cannot be ground into a sufficiently fine state.

In this embodiment, grinding and stirring are carried out in an atmosphere of the gas D, and the oxygen, carbon and nitrogen contents in the material can be controlled by using a gaseous mixture of the gas D and an inert gas, such as Ar. Additionally, any grinder, such as a rotor speed mill, may be used instead of the planetary ball mill.

The resulting soft magnetic alloy powder comprises agglomerates having an average particle size of 1 to 2 μm, in which each (bcc) fine crystalline phase A having an average crystalline grain size of a few nm to a few dozen nm is surrounded with an amorphous phase containing M and D in a large amount. The amorphous phase preferably occupies 50% or more of the texture. Because the (bcc) crystalline grain A as a constituent of the agglomerate is fine, the alloy powder exhibits excellent soft magnetism. Further, because the (bcc) crystalline grain A is surrounded with the high resistance amorphous phase, eddy current loss can be suppressed.

The element A is the primary component for imparting magnetic characteristics to the soft magnetic alloy powder having the general formula set forth above. Although a higher A content is preferable to obtain a higher saturation magnetic flux density, the specific resistance decreases at an A content of 80 atomic % or more, and thus the permeability and Q value are deteriorated at a high-frequency region. Whereas, the saturation magnetic flux density decreases at an A content of 40 atomic % or less. More preferably, the A content ranges from 45 atomic % to 70 atomic %.

The element M is useful to achieve the objective effects set forth above, but an M content of 30 atomic % or more causes the deterioration in magnetic characteristics. To secure the effects set forth above, the M content more preferably ranges from 5 atomic % to 20 atomic %.

The element D is also useful to achieve the objective effects set forth above, but a D content of 50 atomic % or more causes the deterioration in magnetic characteristics, like the element M. To secure the effects set forth above, the D content more preferably ranges from 15 atomic % to 45 atomic %.

Next, the soft magnetic alloy powder is dispersed into a synthetic resin solution in an organic solvent to form a slurry, and then the slurry is repeatedly passed through a three-roll mill until the slurry is converted to powder. The synthetic resin used in the present invention is of low dielectric loss, for example, polypropylene, polyethylene, polystyrene, paraffine, polytetrafluoroethylene, polycarbonate, and silicone resins. The organic solvents for dissolving the synthetic resin may include xylene, toluene, and benzene.

The amount of the soft magnetic alloy powder added to the synthetic resin can be adequately determined in response to magnetic and dielectric characteristics of the targeted composite material. The content of the soft magnetic alloy powder is preferably 50 to 80 volume % of the slurry. When the content of the soft magnetic alloy powder is less than 50 volume %, the permeability may decrease, whereas when a content exceeding 80 volume % may cause difficulty in a molding process, such as injection molding.

Preferably, the soft magnetic alloy powder is annealed in an atmosphere selected from air, oxygen, nitrogen, and water vapor, and a mixture thereof, before dispersing into and mixing with the synthetic resin solution. The annealing is carried out preferably at 25° to 300° C. for 0.5 to 48 hours. By annealing, an oxide insulation layer is formed on the surface of the soft magnetic alloy powder, so that the specific resistance of the powder increases to lower the dielectric constant at a high-frequency. Any insulation layer other than oxide film also may be formed.

After, the organic solvent is removed from the mixture by heating in a drying machine, the mixture is molded into a desired article by press or compression molding, injection molding, extrusion, or the like. The molding is heated at 150° to 400° C. for approximately one hour to endow the high-frequency composite material with the soft magnetic and dielectric characteristics.

Next, a second embodiment of a method for making a high-frequency composite material having soft magnetic and dielectric characteristics in accordance with the present invention will be explained below.

The second method differs from the first method in that after the powder A, the powder M and the powder D are mixed the mixture is ground and stirred in an atmosphere of an inert gas or of a gas D selected from the simple substance gas, oxide gas, carbonate gas of at least one element selected from the group consisting of O, C and N, in the second method, whereas after the powder A and the powder B is mixed the mixture is ground and stirred in an atmosphere of the gas D in the first method.

Examples of the powder D include at least one element selected from the group consisting of C and B.

The grinding and stirring of the powder A, the powder M, and the powder D is carried out in an atmosphere of the gas D, of an inert gas, e.g. Ar, or of a gaseous mixture of the gas D and inert gas. When the gaseous mixture is used, the oxygen, carbon and nitrogen content in the material can be controlled.

The high-frequency composite material having soft magnetic and dielectric characteristics can be produced by the second method.

A third embodiment of a method for making a high-frequency composite material having soft magnetic and dielectric characteristics in accordance with the present invention will be explained below.

The third method differs from the first and second methods in that a ground powder of an A—M alloy ribbon obtained by a liquid quenching method is used instead of the powder A and the powder B.

The A—M alloy ribbon can be prepared by any liquid quenching method, for example, a single roll method in which A—M molten alloy is sprayed from a nozzle on the cooled roll surface while rotating at a high speed; or a double roll method in which A—M molten alloy is jetted between two rotating cooled rolls coming into contact with each other. In the single roll method, a wide and long ribbon having a thickness of 8 to 35 μm and having different surface roughnesses of the roll side face (coming into contact with the roll) and the free face (not coming into contact with the roll), since the A—M molten alloy is cooled by the contact with the roll surface. On the other hand, in the double roll method, a thicker ribbon having a smooth surfaces and a uniform thickness is obtainable compared with the single roll method, but a wide and long ribbon is barely obtainable, because the both surfaces of the thin ribbon coming into contact with the rolls and are cooled with pressure. The prepared A—M alloy ribbon is ground and placed into a high energy planetary ball mill.

The high-frequency composite material having soft magnetic and dielectric characteristics can be produced by the third method.

A fourth embodiment of a method for making a high-frequency composite material having soft magnetic and dielectric characteristics in accordance with the present invention will be explained below.

The fourth method differs from the first and second methods in that a ground powder of an A—M alloy ribbon obtained by a liquid quenching method is used together with the powder A, the powder M, and the powder D and/or the gas D.

The high-frequency composite material having soft magnetic and dielectric characteristics can be produced by the fourth method.

The composite material obtained by the method set forth above has a specific resistance of 108 Ω·cm or more, a dielectric characteristics as an insulator (dielectric) due to the synthetic resin, and soft magnetism due to the soft magnetic alloy powder, at the same time. In particular, at a high-frequency region of a few hundred MHz or more, the composite material has a high Q value, for example, Q=30 at 1 GHz, as well as excellent magnetic characteristics, and thus it can be used at a range from a few hundred MHz to a GHz zone, differing from prior art magnetic materials.

Further, since the high-frequency composite material comprises the soft magnetic alloy powder dispersed into the synthetic resin, the material can be readily molded compared with the sole soft magnetic alloy powder.

The high-frequency composite material in accordance with the present invention can be readily molded into a desirable shape, e.g. a rod, compared with prior art thin film materials, and thus can be widely applied to magnetic parts, e.g. LC television antennas, magnetic head cores, transformer cores, and magnetic cores of pulse motors. Further, magnetic parts having excellent magnetic characteristics and low dielectric loss at a high-frequency region is obtainable from the high-frequency composite material, and the magnetic parts can be miniaturized. For example, when an LC television antenna is produced with the high-frequency composite material in accordance with the present invention, the sending/receiving level of the antenna is improved and the more compact antenna can be produced.

EXAMPLES

The present invention will now be explained in detail based on several examples and a comparative examples but the present invention is not limited to these Examples.

Example 1

After 11.49 g of electrolytic iron (Toho Zinc Co., Ltd., less than 200 mesh) and 4.61 g of zirconium oxide (Daiichi-Kigenso Co., Ltd., less than 45 μm) were weighed and placed into a 170-ml stainless steel pot (SUS 304), oxygen gas was introduced. After 238 g of stainless balls (diameter 4 mm) of the same materials as the pot were placed into the pot, the content was subjected to a mechanical alloying process. The content was mixed by grinding and stirring using a high energy planetary ball mill (Kurimoto Limited) at a centrifugal acceleration of 100 G, a rotation speed/revolution speed ratio of 448 rpm/588 rpm, for 8 hours to obtain $Fe_aZr_bO_c$ alloy powder, wherein a is 55, b is 10, and c is 35. FIG. 1 is an electron microscopic photograph illustrating the particle structure of the $Fe_aZr_bO_c$ alloy powder.

Figure 2:
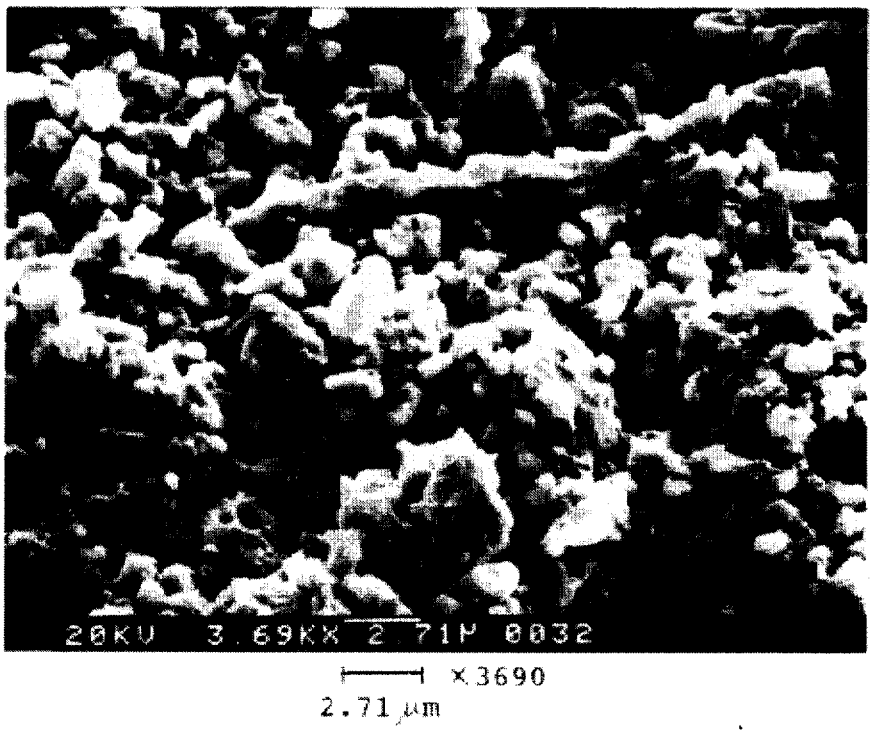
FIG. 2 is an electron microscopic photograph illustrating the surface structure of the composite material particles comprising Fe—Zr—O and a polystyrene resin obtained in Example 1.

The obtained $Fe_aZr_bO_c$ alloy powder was annealed in air at 100° C. for 2 hours to form an oxide insulation film on the powder surface, a polystyrene resin in xylene solution was added to the $Fe_aZr_bO_c$ alloy powder to obtain a slurry until the $Fe_aZr_bO_c$ alloy powder content reaches 50 volume %. The slurry was repeatedly passed through a three-roll mill to obtain a composite powder comprising the $Fe_aZr_bO_c$ alloy powder and polystyrene resin. The composite powder was dried in a drying machine at 80° C. for 12 hours. A disk mold article was made of the dry composite powder with a compression mold. The disk mold article was dried at 150° C. for 1 hour to obtain a composite material comprising Fe—Zr—O and a polystyrene resin and having an outer diameter of 15 mm and a thickness of 3 mm. FIG. 2 is an electron microscopic photograph illustrating the surface structure of the composite material particles comprising Fe—Zr—O and a polystyrene resin.

Example 2

A composite material comprising Fe—Zr—O and a polystyrene resin was prepared by the method identical to Example 1, except that an insulation layer is formed by oxidizing the surface of the $Fe_aZr_bO_c$ alloy powder obtained by the mechanical alloying process, at 120° C. for 4 hours in air.

Comparative Example

Ni ferrite is used for antennas for pagers as a magnetic material in the most high-frequency region. From Ni ferrite used in a pager (resonance frequency: 172 MHz) made by Motorola, Inc., a ϕ8.0–ϕ4.0–t1.5 mm ring sample and a ϕ15.0–t2.0 mm disk sample were prepared by cutting for a comparative magnetic material.

Test 1

The specific resistance and permeability of each composite material obtained by Examples 1 and 2 and of the magnetic material obtained by Comparative Example, as well as the Q values as their respective magnetic members, were evaluated. The specific resistance is measured by using a disk testing sample with carbon tapes on the both faces with a super mega-ohm meter Model SM-9E by Toa Electronics Ltd. The permeability and the Q value as the magnetic member were measured by using a ϕ8.0–ϕ4.0–t1.5 mm ring sample and ϕ15.0–t2.0 mm disk sample with a material analyzer 4291A by Hewlett-Packard Company at a frequency range from 1 MHz to 1.8 GHz. The results are shown in FIGS. 3 to 6.

Figure 3:
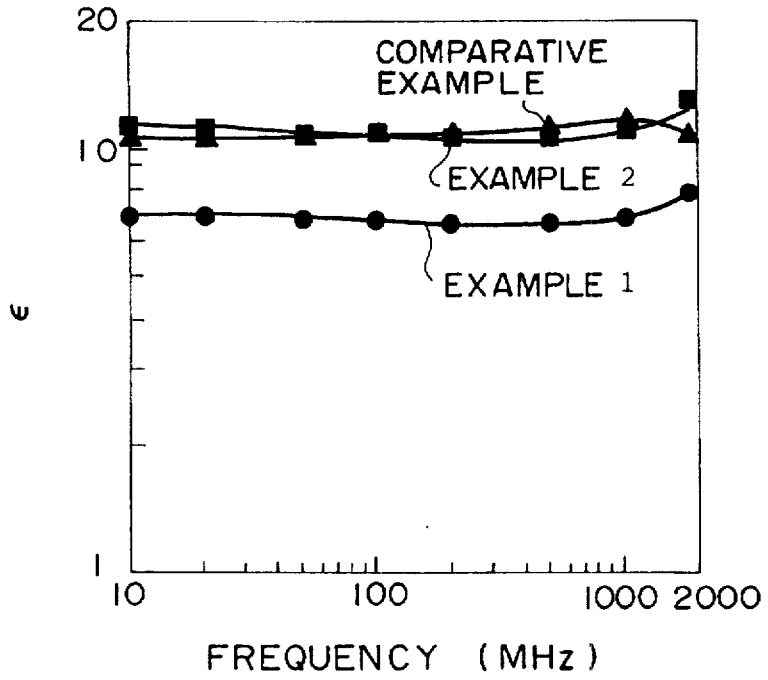
FIG. 3 is a graph illustrating the dielectric constant ($\epsilon$) as a function of the frequency.
Figure 4:
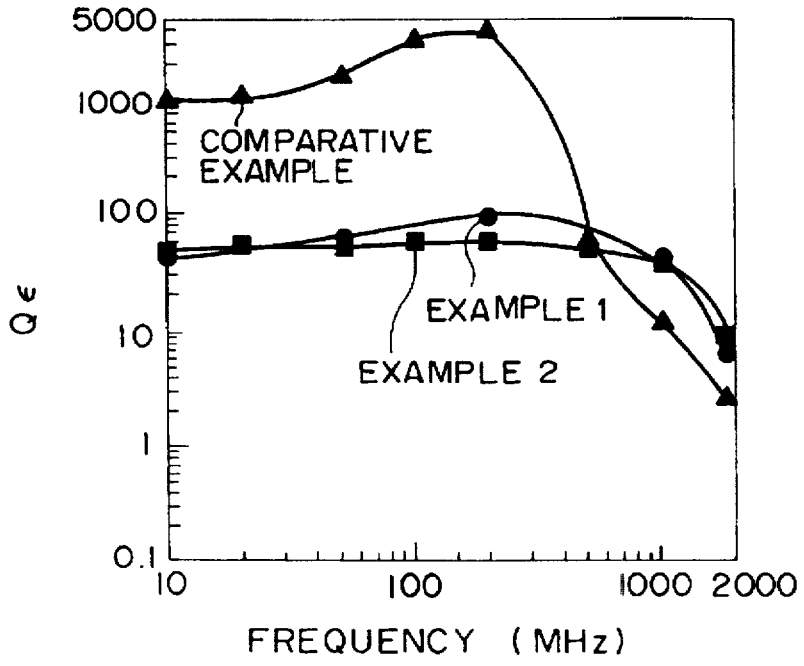
FIG. 4 is a graph illustrating the value of Q ($Q\epsilon$) of dielectric members as a function of the frequency.
Figure 5:
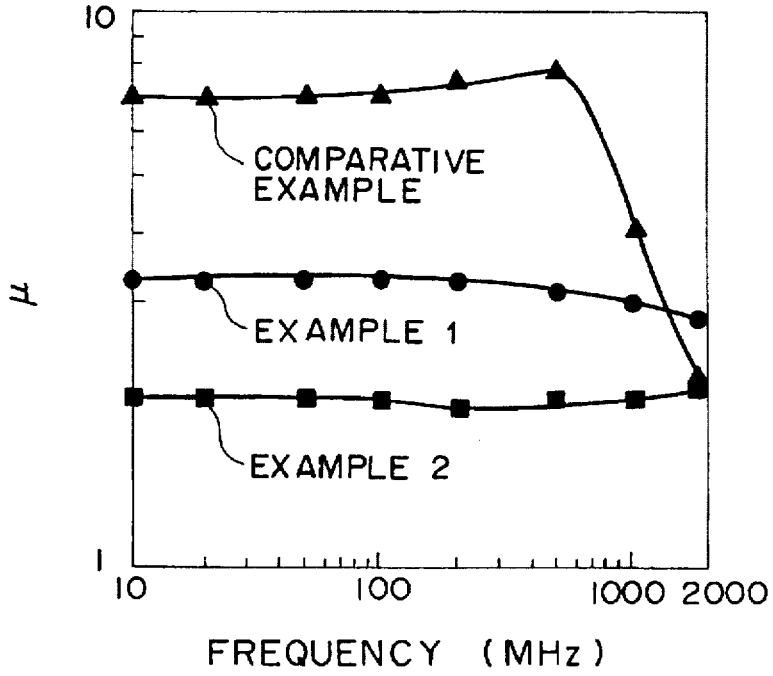
FIG. 5 is a graph illustrating the permeability ($\mu$) as a function of the frequency.
Figure 6:
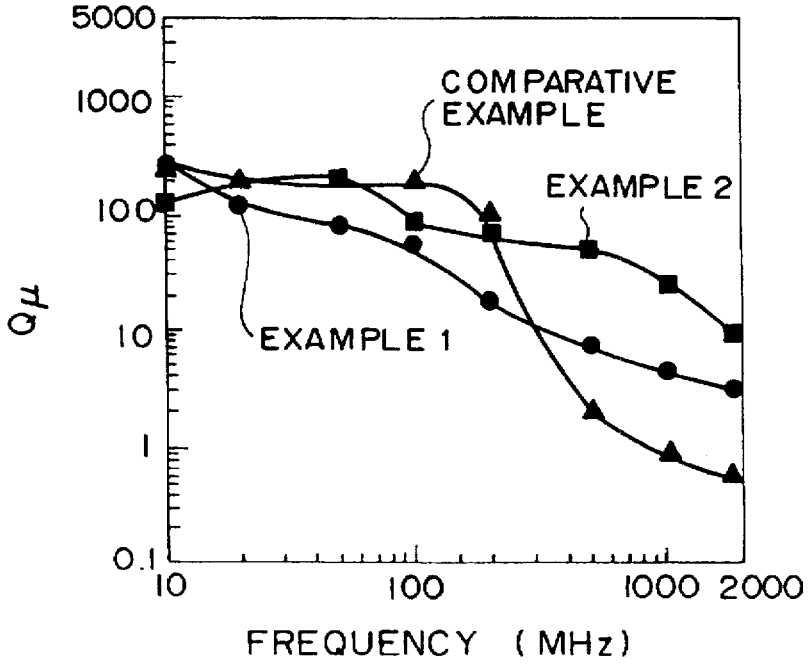
FIG. 6 is a graph illustrating the value of Q ($Q\mu$) of dielectric members as a function of the frequency.

FIG. 3 is a graph illustrating the dielectric constant (ε) as a function of the frequency, FIG. 4 is a graph illustrating the value of Q (Qε) of a dielectric member as a function of the frequency, FIG. 5 is a graph illustrating the permeability (μ) as a function of the frequency, and FIG. 6 is a graph illustrating the value of Q (Qμ) of a dielectric member as a function of the frequency.

FIG. 3 evidently demonstrates that the composite material obtained in Example 1 has dielectric characteristics similar to the magnetic material in Comparative Example, and the composite material obtained at a higher heating temperature and for a longer heating time in Example 2 has a smaller dielectric constant than the materials in Example 1 and Comparative Example.

FIG. 4 demonstrates that the composite materials in Examples 1 and 2 exhibit excellent magnetic loss characteristics, i.e., larger Qe values than that in Comparative Example at a high-frequency region of 800 MHz or more.

FIG. 5 demonstrates that the composite materials in Examples 1 and 2 exhibit stable permeability at a high-frequency region of 800 MHz or more, whereas the permeability of the magnetic material in Comparative Example decreases with the increase in the frequency. In particular, the composite material in Example 1 exhibits a higher permeability than that in Comparative Example at a high-frequency region of approximately 1,500 MHz or more.

FIG. 6 demonstrates that the composite materials in Examples 1 and 2 exhibit larger Qε values than that in Comparative Example at a high-frequency region of 400 MHz or more.

Test 2

A series of Fe—Zr—O-silicone resin composite materials (Samples 1 to 15) were prepared by dispersing $Fe_aZr_bO_c$ alloy powders into a silicone resin, by mixing them and by forming the mixture, of which the atomic percents were varied within follows: from 45 to 100 atomic % for Fe, 5 to 20 atomic % for Zr, and 15 to 45 atomic % for O, similar to Example 1.

The correlation between the composition of $Fe_aZr_bO_c$ alloy powder and the μ' values at room temperature and at 100 MHz and 500 MHz, and the Qμ values at room temperature, and at 100 MHz, 500 MHz and 1 GHz. The results are shown in Table 1 and FIGS. 7 to 11.

TABLE 1

| Sample No. | Composition Fe (at %) | Zr (at %) | O (at %) | Qμ *1 | μ' *2 | Qμ *3 |
|---|---|---|---|---|---|---|
| 1 | 55 | 10 | 35 | 142.9/56.5 | 3.2/3.3 | 17.4 |
| 2 | 60 | 5 | 35 | 111.3/48.1 | 3.0/3.0 | 19.9 |
| 3 | 55 | 20 | 25 | 110.0/17.3 | 2.7/2.7 | 7.6 |
| 4 | 60 | 15 | 25 | 114.3/14.5 | 3.2/3.2 | 6.4 |
| 5 | 70 | 5 | 25 | 136.7/27.8 | 3.6/3.7 | 6.6 |
| 6 | 65 | 20 | 15 | 25.9/16.1 | 1.8/1.7 | 10.7 |
| 7 | 70 | 15 | 15 | 92.2/10.8 | 3.6/3.7 | 4.9 |
| 8 | 75 | 10 | 15 | 132.2/10.0 | 3.9/4.1 | 4.4 |
| 9 | 45 | 10 | 45 | 70.9/31.4 | 1.9/1.9 | 20.7 |
| 10 | 50 | 5 | 45 | 107.6/37.9 | 2.5/2.6 | 18.4 |
| 11 | 55 | 0 | 45 | 107.7/41.1 | 2.5/2.5 | 21.1 |
| 12 | 50 | 15 | 35 | 87.0/55.4 | 1.6/1.6 | 35.2 |
| 13 | 65.3 | 8.9 | 25.8 | 146.5/27.9 | 3.8/4.0 | 7.1 |
| 14 (for Comparison)*4 | 100 | 0 | 0 | 12.3/3.6 | 5.0/4.3 | 2.4 |
| 15 (for Comparison)*5 | 100 | 0 | 0 | 2.2/1.6 | 3.9/2.1 | 1.4 |

Figure 7:
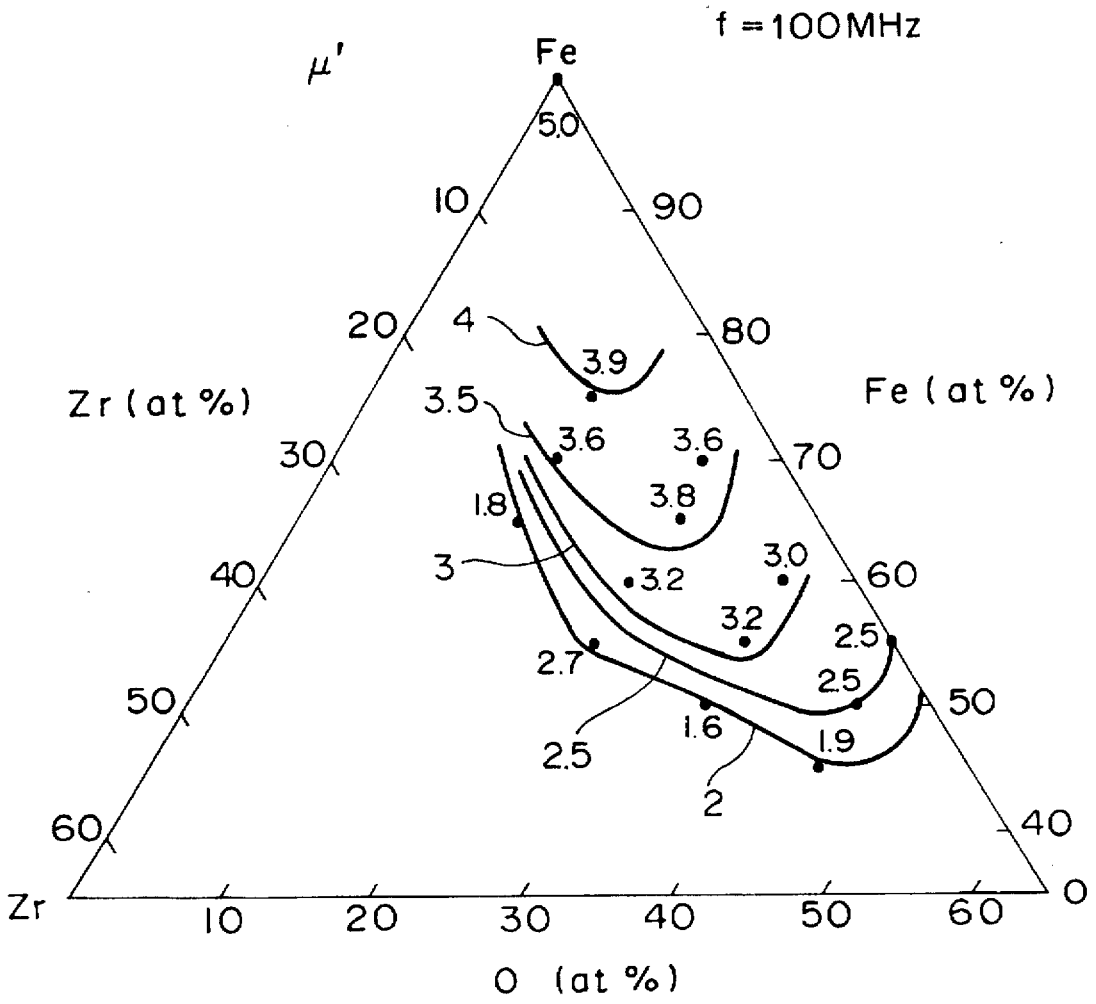
FIG. 7 is a ternary diagram illustrating the value of $\mu'$ at 100 MHz and at room temperature as a function of the composition of the alloy powder having a general formula of $Fe_aZr_bO_c$ in each Fe—Zr—O-silicone resin composite material and Fe-silicone resin composite material.

*1 Qμ at f = 100 MHz/Qμ at f = 500 MHz
*2 μ' at f = 100 MHz/μ' at f = 500 MHz
*3 Qμ at f = 1 GHz
*4 MA
*5 Non-electrolytic iron FIG. 7 is a ternary diagram illustrating the μ' value at 100 MHz and at room temperature as a function of the composition of the alloy powder having a general formula of $Fe_aZr_bO_c$ in each Fe—Zr—O-silicone resin composite material and Fe-silicone resin composite material, in which the μ' value is shown above each point representing the composition of the respective alloy powder.

Figure 8:
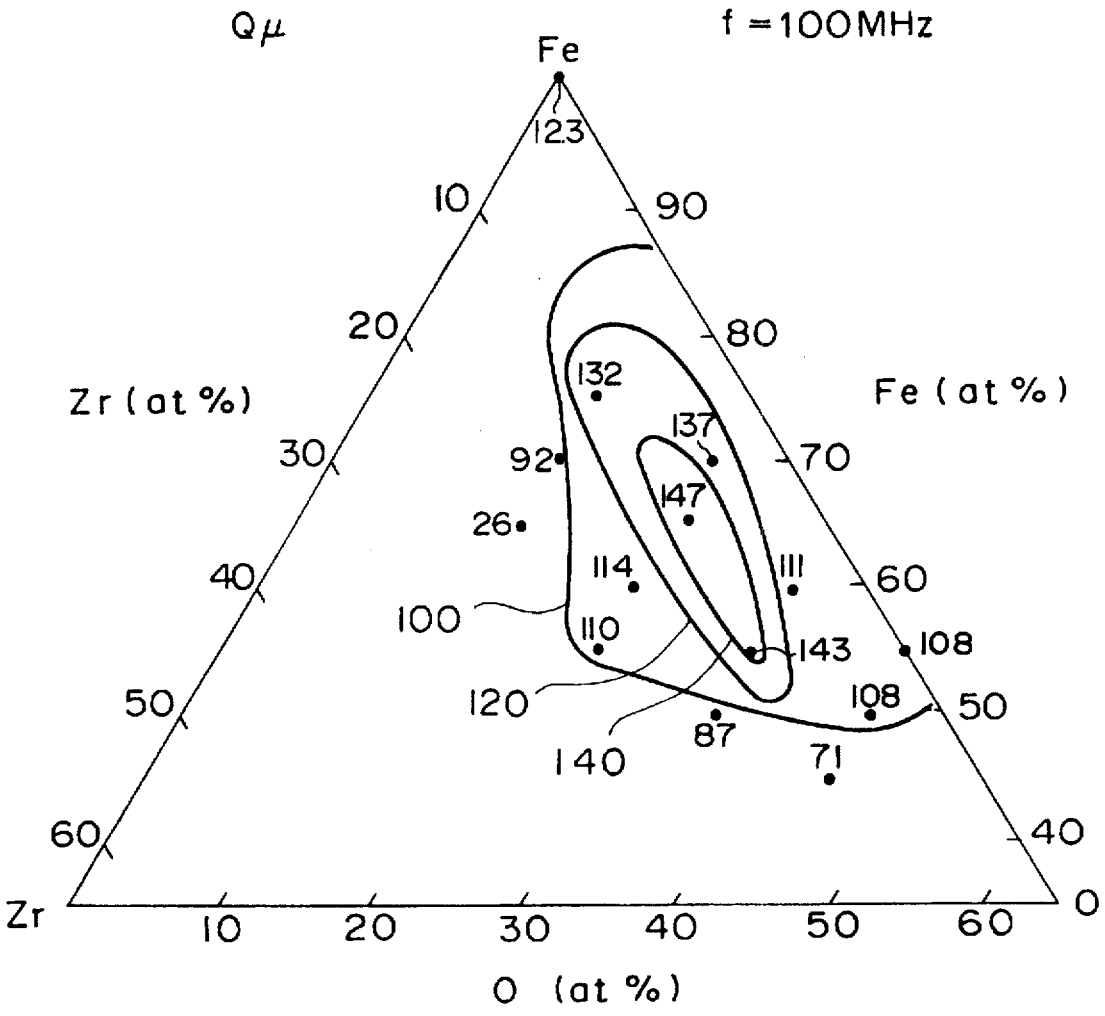
FIG. 8 is a ternary diagram illustrating the value of $Q\mu$ at 100 MHz and at room temperature as a function of the composition of the alloy powder having a general formula of $Fe_aZr_bO_c$ in each Fe—Zr—O-silicone resin composite material and Fe-silicone resin composite material.

FIG. 8 is a ternary diagram illustrating the value of Qμ at 100 MHz and at room temperature as a function of the composition of the alloy powder having a general formula of $Fe_aZr_bO_c$ in each Fe—Zr—O-silicone resin composite material and Fe-silicone resin composite material, in which the Qμ value is shown above each point representing the composition of the respective alloy powder.

Figure 9:
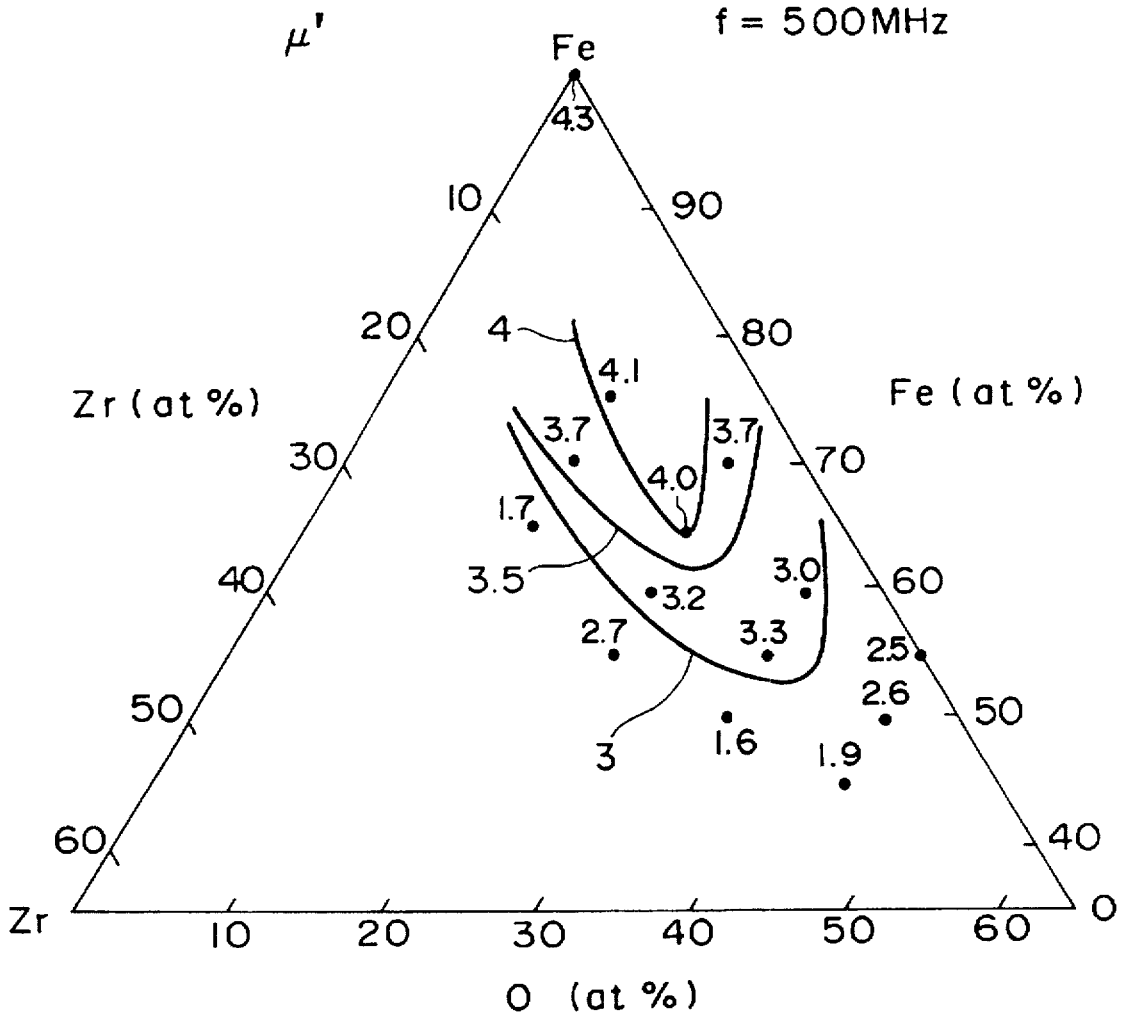
FIG. 9 is a ternary diagram illustrating the value of $\mu'$ at 500 MHz and at room temperature as a function of the composition of the alloy powder having a general formula of $Fe_aZr_bO_c$ in each Fe—Zr—O-silicone resin composite material and Fe-silicone resin composite material.

FIG. 9 is a ternary diagram illustrating the value of μ' at 500 MHz and at room temperature as a function of the composition of the alloy powder having a general formula of $Fe_aZr_bO_c$ in each Fe—Zr—O-silicone resin composite material and Fe-silicone resin composite material, in which the μ' value is shown above each point representing the composition of the respective alloy powder.

Figure 10:
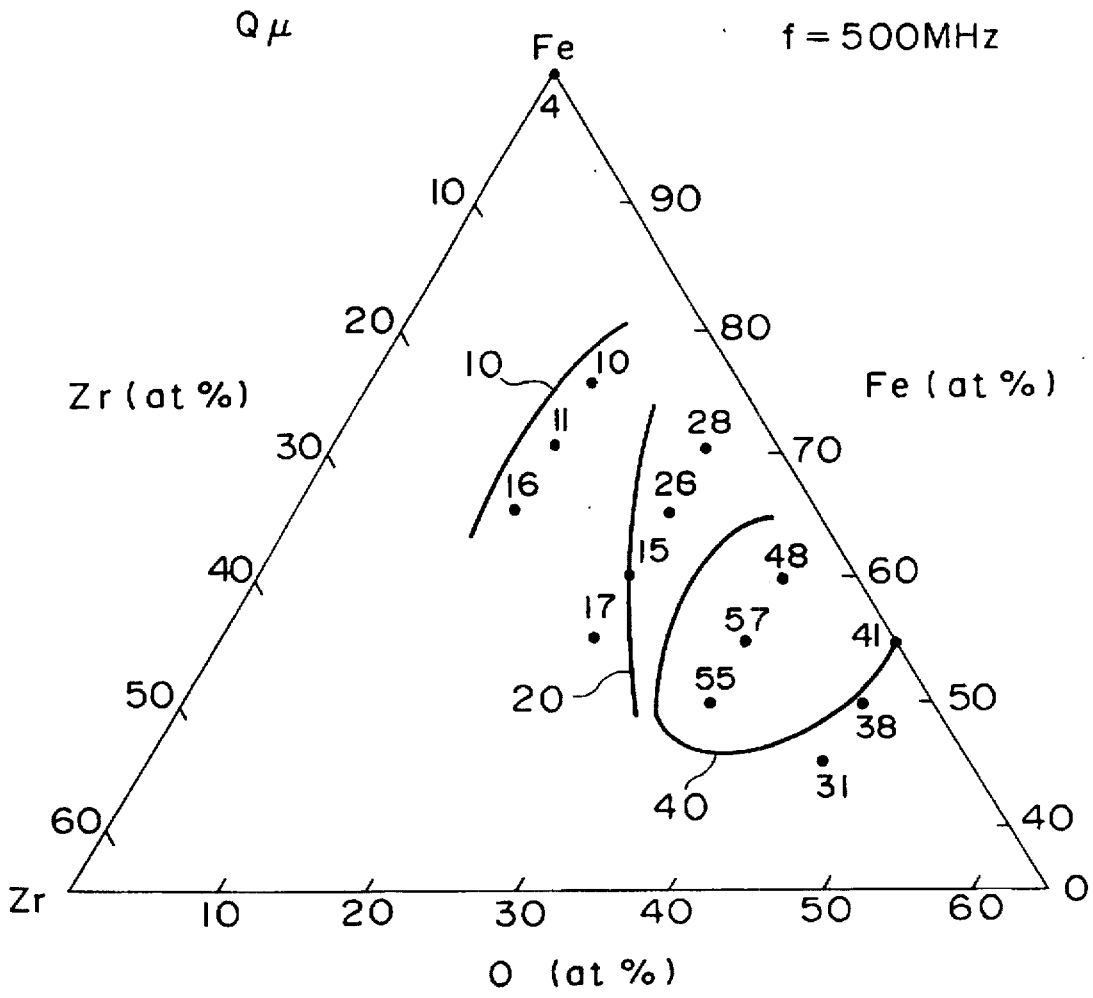
FIG. 10 is a ternary diagram illustrating the value of $Q\mu$ at 500 MHz and at room temperature as a function of the composition of the alloy powder having a general formula of $Fe_aZr_bO_c$ in each Fe—Zr—O-silicone resin composite material and Fe-silicone resin composite material.

FIG. 10 is a ternary diagram illustrating the value of Qμ at 500 MHz and at room temperature as a function of the composition of the alloy powder having a general formula of $Fe_aZr_bO_c$ in each Fe—Zr—O-silicone resin composite material and Fe-silicone resin composite material, in which the Qμ value is shown above each point representing the composition of the respective alloy powder.

Figure 11:
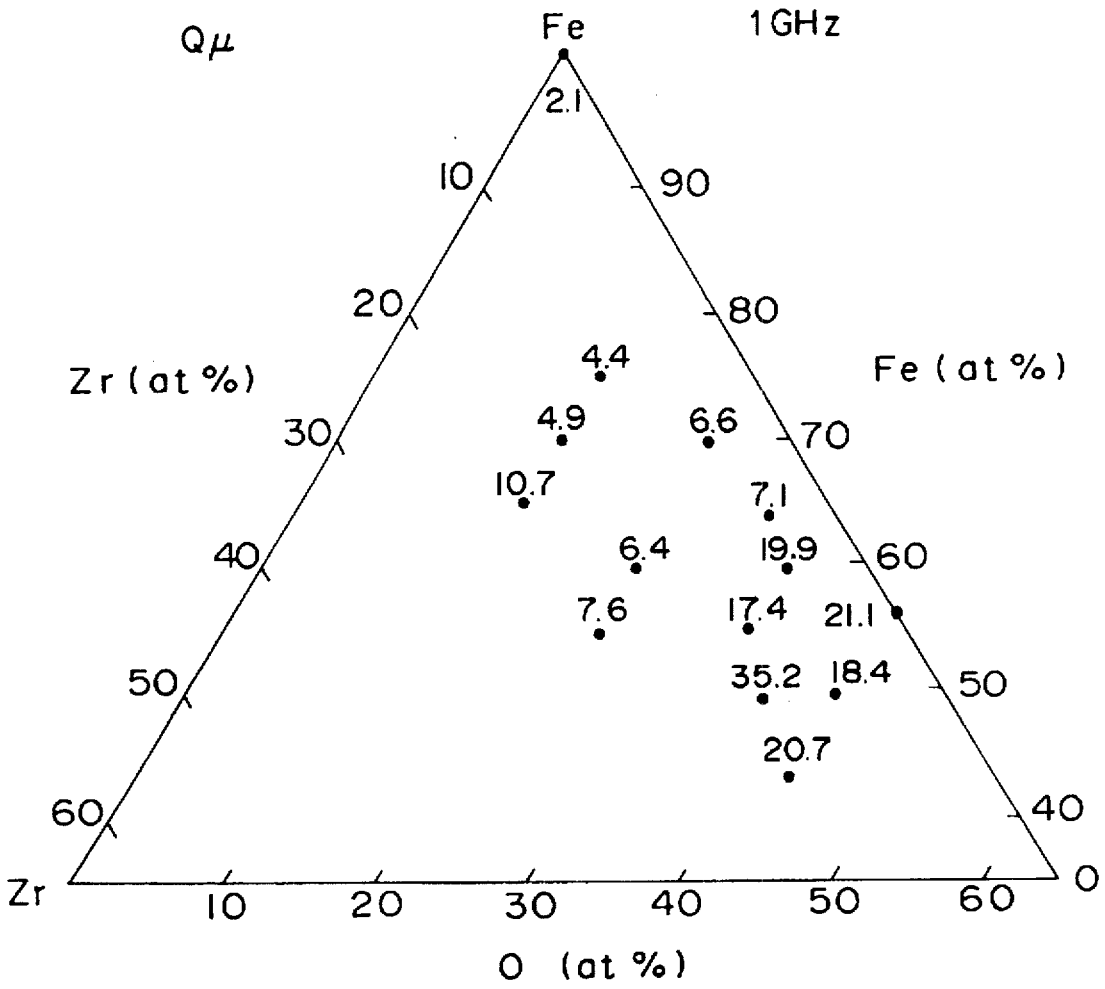
FIG. 11 is a ternary diagram illustrating the value of $Q\mu$ at 1 GHz and at room temperature as a function of the composition of the alloy powder having a general formula of $Fe_aZr_bO_c$ in each Fe—Zr—O-silicone resin composite material and Fe-silicone resin composite material.

FIG. 11 is a ternary diagram illustrating the value of Qμ at 1 GHz and at room temperature as a function of the composition of the alloy powder having a general formula of $Fe_aZr_bO_c$ in each Fe—Zr—O-silicone resin composite material and Fe-silicone resin composite material, in which the Qμ value is shown above each point representing the composition of the respective alloy powder.

Table 1 and FIGS. 7 to 11 evidently demonstrate that each Fe—Zr—O-silicone resin composite material in Samples 1 to 13 as Examples in accordance with the present invention has a higher Qμ value than those in Samples 14 and 15 for comparison at 100 MHz, 500 MHz and 1 GHz. In particular, each composite material containing 45 to 70 atomic percent of Fe, 0 to 20 atomic percent of Zr, and 15 to 45 atomic percent of O has a Qμ value higher than 4 at a 1 GHz, and the material in Sample 12 has an extremely high Qμ value, i.e., 35.2.

Test 3

A series of Fe—W—O-silicone resin composite materials (Samples 16 to 25) were prepared by dispersing $Fe_aW_bO_c$ alloy powders into a silicone resin, by mixing them and by forming the mixture, of which the atomic percents were varied within ranges as follows: from 55 to 75 atomic % for Fe, 5 to 20 atomic % for W, and 15 to 35 atomic % for O, similar to Example 1.

The correlation between the composition of $Fe_aW_bO_c$ alloy powder and the Qμ values at room temperature and at 1 GHz. The results are shown in Table 2 and FIG. 12.

TABLE 2

| Sample No. | Composition Fe (at %) | W (at %) | O (at %) | Qμ |
|---|---|---|---|---|
| 16 | 55 | 10 | 35 | 11.9 |
| 17 | 60 | 5 | 35 | 10.1 |
| 18 | 55 | 20 | 25 | 5.5 |
| 19 | 60 | 15 | 25 | 5.5 |
| 20 | 70 | 5 | 25 | 12.6 |
| 21 | 65 | 20 | 15 | 4.1 |
| 22 | 70 | 15 | 15 | 4.2 |
| 23 | 75 | 10 | 15 | 3.9 |
| 24 | 65.3 | 8.9 | 25.8 | 4.9 |
| 25 | 65.3 | 8.9 | 25.8 | 4.9 |

Figure 12:
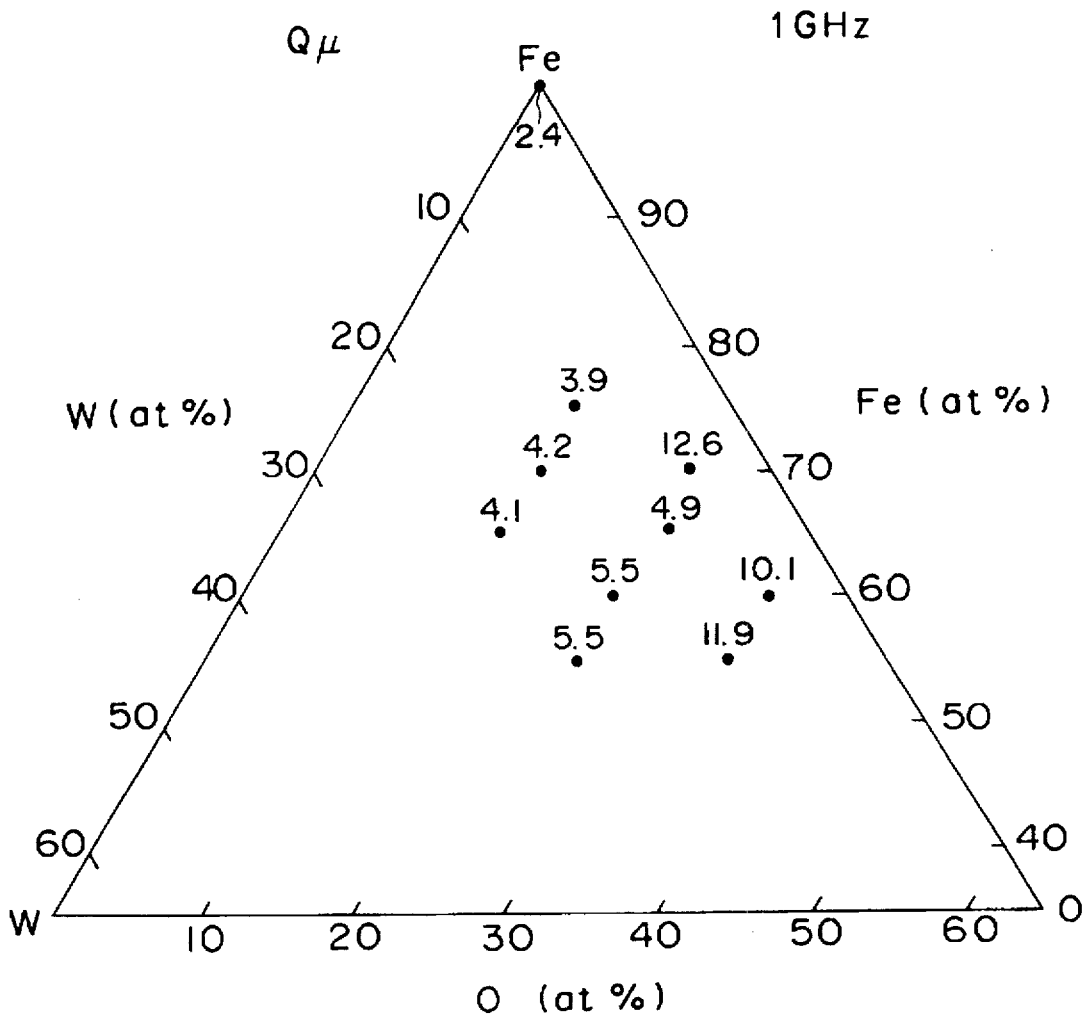
FIG. 12 is a ternary diagram illustrating the value of $Q\mu$ at 1 GHz and at room temperature as a function of the composition of the alloy powder having a general formula of $Fe_aW_bO_c$ in each Fe—W—O-silicone resin composite material.

FIG. 12 is a ternary diagram illustrating the value of Qμ at 1 GHz and at room temperature as a function of the composition of the alloy powder having a general formula of $Fe_aW_bO_c$ in each Fe—W—O-silicone resin composite material, in which the Qμ value is shown above each point representing the composition of the respective alloy powder.

Tables 1 and 2 and FIG. 12 evidently demonstrate that each Fe—W—O-silicone resin composite material in Samples 16 to 25 as Examples in accordance with the present invention has a higher Qμ value than Fe-silicone resin composite materials in Samples 14 and 15 for comparison at 1 GHz within the range of 45 to 70 atomic percent of Fe, 0 to 20 atomic percent of Zr, and 15 to 45 atomic percent of O.

Example 3

Figure 13:
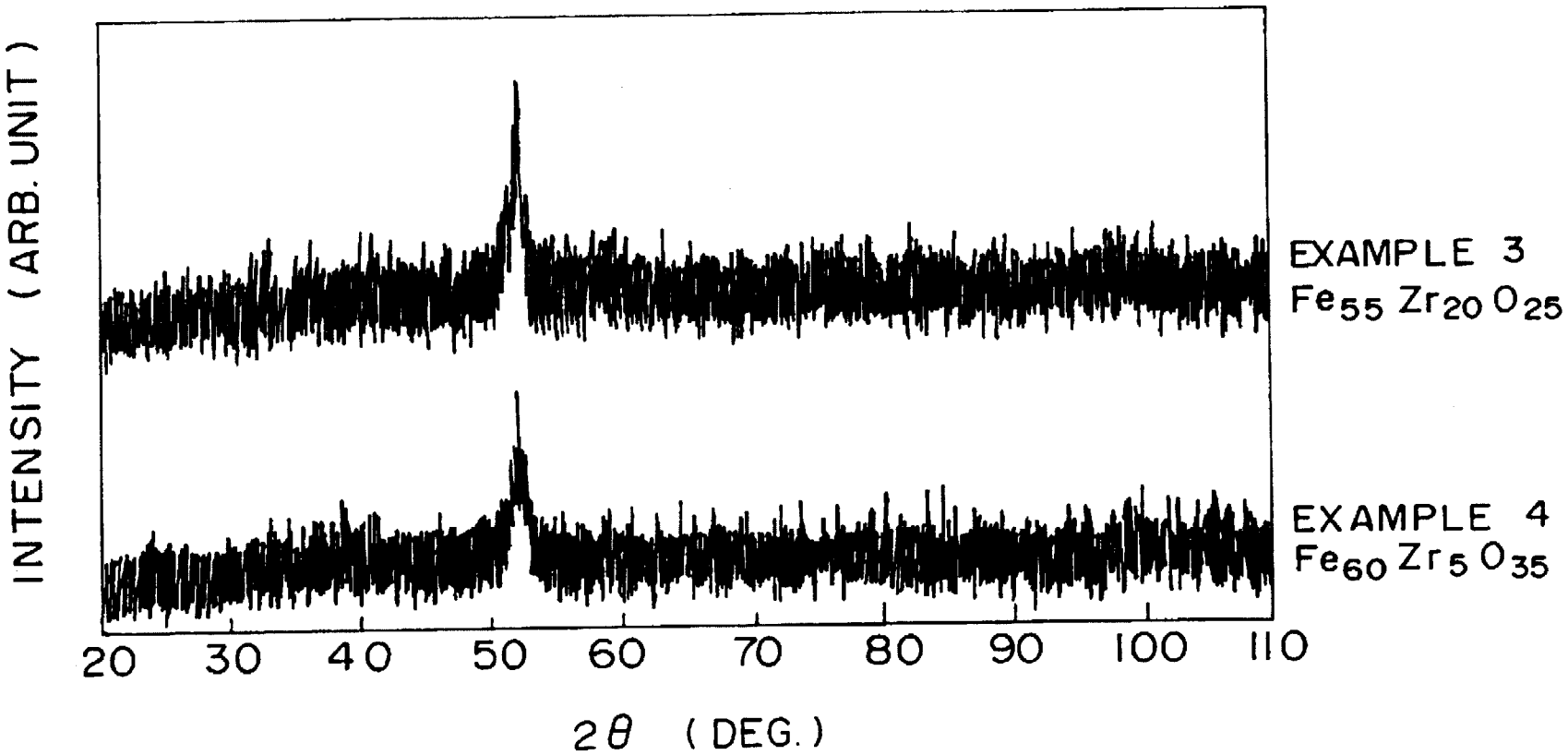
FIG. 13 is a graph illustrating the results of X-ray diffractometry of $Fe_{55}Zr_{20}O_{25}$ alloy powder in Example 3 and $Fe_{60}Zr_5O_{35}$ alloy powder in Example 4.

After 9.860 g of electrolytic iron (Toho Zinc Co., Ltd., less than 200 mesh), 4.944 g of zirconium oxide (Daiichi-Kigenso Co., Ltd., less than 45 μm) and 2.196 g of zirconium were weighed and placed into a 170-ml stainless steel pot (SUS 304), oxygen gas was introduced. After 238 g of stainless balls (diameter 4 mm) of the same materials as the pot were placed into the pot, the content was subjected to a mechanical alloying process. The content was mixed by grinding and stirring using a high energy planetary ball mill (Kurimoto Limited) at a centrifugal acceleration of 100 G, a rotation speed/revolution speed ratio of 448 rpm/588 rpm, for 8 hours to obtain $Fe_{55}Zr_{20}O_{25}$ alloy powder. The result of the X-ray diffractometry of the obtained $Fe_{55}Zr_{20}O_{25}$ alloy powder will be shown in FIG. 13.

Example 4

After 13.044 g of electrolytic iron (Toho Zinc Co., Ltd., less than 200 mesh) and 2.398 g of zirconium oxide (Daiichi-Kigenso Co., Ltd., less than 45 μm) were weighed and placed into a 170-ml stainless steel pot (SUS 304), 1.577 g of oxygen gas was introduced. After 238 g of stainless balls (diameter 4 mm) of the same materials as the pot were placed into the pot, the content was subjected to a mechanical alloying process. The content was mixed and ground with stirring using a high energy planetary ball mill (Kurimoto Limited) at a centrifugal acceleration of 100 G, a rotation speed/revolution speed ratio of 448 rpm/588 rpm, for 8 hours to obtain $Fe_{60}Zr_5O_{35}$ alloy powder. The result of the X-ray diffractometry of the obtained $Fe_{60}Zr_5O_{35}$ alloy powder will also be shown in FIG. 13.

The $Fe_{55}Zr_{20}O_{25}$ and $Fe_{60}Zr_5O_{35}$ alloy powders in Examples 3 and 4 have X-ray diffraction patterns similar to each other, in spite of different raw material formulations.

Examples 5 to 9

After 7.935 g of electrolytic iron (Toho Zinc Co., Ltd., less than 200 mesh) and 9.065 g of hafnium oxide (Kojundo Chemical Laboratory Co., Ltd., 2 μm) were weighed and placed into a 170-ml stainless steel pot (SUS 304), inert gas was introduced. Five kinds of $Fe_aHf_bO_c$ powder (a=54.9, b=11 and c=34.1) were prepared by various mechanical alloying times, i.e., 0.5 hours, 2 hours, 8 hours, 16 hours and 60 hours. Using a high energy planetary ball mill (Kurimoto Limited) of which the pot is filled with 238 g of stainless balls (diameter 4 mm) of the same materials as the pot, the content was mixed by grinding and stirring at a centrifugal acceleration of 100 G, a rotation speed/revolution speed ratio of 448 rpm/588 rpm.

Figure 14:
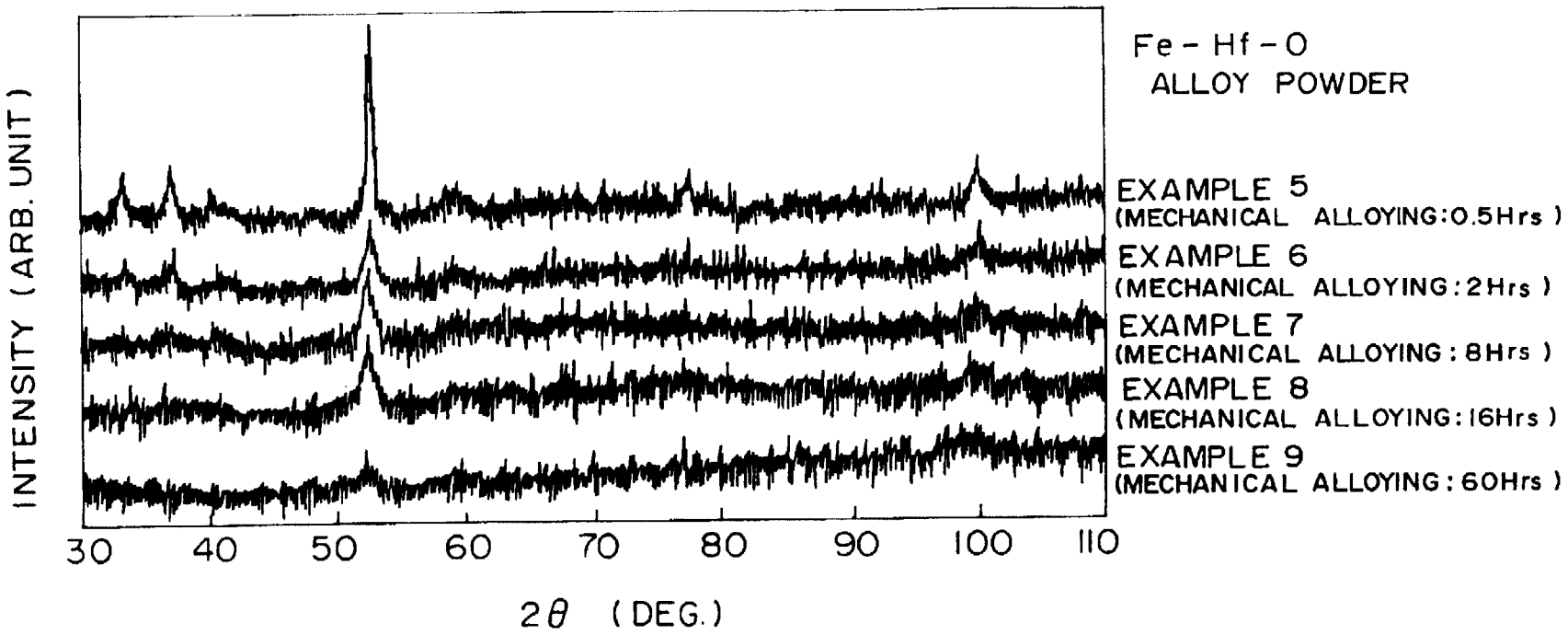
FIG. 14 is a graph illustrating the results of X-ray diffractometry of Fe—Hf—O alloy powders obtained in Examples 5 to 9.

Mechanical alloying times for obtaining $Fe_aHf_bO_c$ alloy powders in Examples 5, 6, 7, 8 and 9 were 0.5, 2, 8, 16 and 60 hours, respectively. The results of the X-ray diffractometry of the obtained Fe—Hf—O alloy powders will also be shown in FIG. 14. FIG. 14 evidently demonstrates that Hf and O are incorporated in Fe and the peak intensities at the $2\theta=55°$ and $2\theta=100°$ decrease, and thus the mechanical alloying process proceeds with the time.

Because the high-frequency composite material exhibiting soft magnetic and dielectric characteristics in accordance with the present invention comprises a synthetic resin having a small dielectric loss and a soft magnetic alloy powder having the general formula $A_aM_bD_c$ as set forth above, the specific resistance of the obtained composite material is $10^8$ Ω·cm or more, the composite material has the dielectric characteristics as the insulator (or dielectric member) of the synthetic resin and the soft magnetism of the soft magnetic alloy powder. In particular, the composite material has a high Q value, as well as excellent magnetic characteristics, at a high-frequency region of a few hundreds MHz or more, for example, Q=30 at 1 GHz. Thus, the composite material can be used in a few hundreds MHz to a few GHz region in which no conventional magnetic material is available. Further, in the high-frequency composite material, the soft magnetic alloy powder is dispersed into the synthetic resin, and thus a desired product can be readily formed compared with the production from only the soft magnetic alloy powder.

Accordingly, because a desired shape, such as a rod, can be formed from the high-frequency composite material in accordance with the present invention, the composite material is widely applicable to LC television antennas, magnetic head cores, transformer cores, and magnetic parts such as magnetic cores of pulse motors. Further, the composite material has excellent magnetic characteristics at a high-frequency region, can form a magnetic part having a low dielectric loss, and enables the magnetic part to miniaturize. For example, a compact LC television antenna with an improved sending/receiving level can be produced from this composite material.

The production method in accordance with the present invention is preferably used for the production of high-frequency composite materials having soft magnetic and dielectric characteristics, as set forth above.

What is claimed is:

1. A high-frequency composite material, having soft magnetic and dielectric characteristics, comprising a soft magnetic alloy powder represented by the general composition $A_aM_bD_c$ and a synthetic resin, wherein A represents at least one element or mixture thereof selected from the group consisting of Fe, Co and Ni, M represents at least one element or mixture thereof selected from the group consisting of Hf, Zr, W, Ti, V, Nb, Mo, Cr, Mg, Mn, Al, Si, Ca, Sr, Ba, Cu, Ga, Ge, As, Se, Zn, Cd, In,Sn, Sb, Te, Pb, Bi, and rare earth elements, and D represents at least one element or mixture thereof selected from the group consisting of O, C and N, wherein the suffixes a, b, and c in said general formula $A_aM_bD_c$ satisfy the following equations represented by atomic percent:

$40<a<80$, $0<b<30$, and $0<c<50$, and wherein soft magnetic alloy powder comprises agglomerates having an average particle size of 1 to 2 μm, where each agglomerate includes A in the form of body centered cubic (bcc) fine crystalline grains having an average grain size of a few nm to a few dozen nm, wherein the (bcc) fine crystalline phase is surrounded by an amorphous phase comprising M and D which occupies 50% or more of said agglomerates.

2. A high-frequency composite material according to claim 1, wherein an insulation layer is formed on the surface of said soft magnetic alloy powder.

3. A method for making a high-frequency composite material having soft magnetic and dielectric characteristics comprising:

forming a soft magnetic alloy powder having a general formula $A_aM_bD_c$ by a mechanical alloying process comprising mixing by grinding and stirring a powder A selected from the simple substance, oxide, carbide, carbonate, nitride and boride of at least one element selected from the group consisting of Fe, Co, and Ni, and a powder M selected from the simple substance, oxide, carbide, carbonate, nitride and boride of at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, Bi and rare earth elements, in an atmosphere of a gas D selected from the simple substance gas, oxide gas, and carbonate gas of at least one element selected from the group consisting of O, C and N, or of a gaseous mixture of the gas D and inert gas, wherein the suffixes a, b and c in said general formula $A_aM_bD_c$ satisfy the following equations represented by atomic percent:

$40<a<80$, $0<b<30$, and $0<c<50$, and wherein soft magnetic alloy powder comprises agglomerates having an average particle size of 1 to 2 μm, where each agglomerate includes A in the form of body centered cubic (bcc) fine crystalline grains having an average grain size of a few nm to a few dozen nm, wherein the (bcc) fine crystalline phase is surrounded by an amorphous phase comprising M and D which occupies 50% or more of said agglomerates;

dispersing to mix the soft magnetic alloy powder into a synthetic resin; and molding the mixture into the high-frequency composite material.

4. A method for making a high-frequency composite material having soft magnetic and dielectric characteristics comprising:

forming a soft magnetic alloy powder having a general formula $A_aM_bD_c$ by grinding powder of an A—M alloy ribbon, obtained by a liquid quenching method in an atmosphere of a gas D selected from the simple substance gas, oxide gas, and carbonate gas of at least one element selected from the group consisting of O, C and N, or of a gaseous mixture of the gas D and inert gas, wherein the suffixes a, b, and c in said general formula $A M_bD_c$ satisfy the following equations represented by atomic percent:

$40<a<80$, $0<b<30$, and $0<c<50$, and wherein soft magnetic alloy powder comprises agglomerates having an average particle size of 1 to 2 μm, where each agglomerate includes A in the form of body centered cubic (bcc) fine crystalline grains having an average grain size of a few nm to a few dozen nm, wherein the (bcc) fine crystalline phase is surrounded by an amorphous phase comprising M and D which occupies 50% or more of said agglomerates;

dispersing to mix the soft magnetic alloy powder into a synthetic resin; and molding the mixture into the high-frequency composite material.

5. A method for making a high-frequency composite material according to claim 3, wherein a ground powder of an A—M alloy ribbon obtained by a liquid quenching method is also used when said soft magnetic alloy powder having said general formula $A_aM_bD_c$ is formed by the mechanical alloying method.

6. A method for making a high-frequency composite material having soft magnetic and dielectric characteristics comprising:

forming a soft magnetic alloy powder having the general formula $A_aM_bD_c$ by a mechanical alloying process comprising mixing by grinding and stirring a powder A selected from the simple substance, oxide carbide, carbonate and nitride of at least one element selected from the group consisting of Fe, Co and Ni, a powder M selected from the simple substance, oxide, carbide, carbonate and nitride of at least one element selected from the group consisting of Hf, Zr, W, Ti, V, Nb, Mo, Cr, Mg, Mn, Al, Si, Ca, Sr, Ba, Cu, Ga, Ge, As, Se, Zn, Cd, In, Sn, Sb, Te, Pb, and Bi, and a powder D consists of C, wherein the suffixes a, b, and c in said general formula $A_aM_bD_c$ satisfy the following equations represented by atomic percent:

$40<a<80$, $0<b<30$, and $0<c<50$, and wherein soft magnetic alloy powder comprises agglomerates having an average particle size of 1 to 2 μm, where each agglomerate includes A in the form of body centered cubic (bcc) fine crystalline grains having an average grain size of a few nm to a few dozen nm, wherein the (bcc) fine crystalline phase is surrounded by an amorphous phase comprising M and D which occupies 50% or more of said agglomerates;

dispersing to mix the soft magnetic alloy powder into a synthetic resin; and molding the mixture into the high-frequency composite material.

7. A method for making a high-frequency composite material having soft magnetic and dielectric characteristics comprising:

forming a soft magnetic alloy powder having the general formula $A_aM_bD_c$ by grinding powder of an A—M alloy ribbon, obtained by a liquid quenching method in an atmosphere of a gas D selected from the simple substance gas, oxide gas and carbonate gas of C, wherein the suffixes a, b, and c in said general formula $A_aM_bD_c$ satisfy the following equations represented by atomic percent:

$40<a<80$, $0<b<30$, and $0<c<50$, and wherein soft magnetic alloy powder comprises agglomerates having an average particle size of 1 to 2 μm, where each agglomerate includes A in the form of body centered cubic (bcc) fine crystalline grains having an average grain size of a few nm to a few dozen nm, wherein the (bcc) fine crystalline phase is surrounded by an amorphous phase comprising M and D which occupies 50% or more of said agglomerates;

dispersing to mix the soft magnetic alloy powder into a synthetic resin;

and molding the mixture into the high-frequency composite material.

8. A method for making a high-frequency composite material according to claim 6, wherein a ground powder of an A—M alloy ribbon obtained by a liquid quenching method is also used when said soft magnetic alloy powder having said general formula $A_aM_bD_c$ is formed by the mechanical alloying method.

9. A method for making a high-frequency composite material according to claim 6, wherein said soft magnetic alloy powder having the general formula $A_aM_bD_c$ is formed by the mechanical alloying process in an atmosphere of a gas D selected from the simple substance gas, oxide gas and carbonate gas of at least one element selected from the group consisting of O, C and N, or of a gaseous mixture of the gas D and inert gas.

* * * * *

UNITED STATES PATENT AND TRADEMARK OFFICE

CERTIFICATE OF CORRECTION

PATENT NO. : 5,755,986
DATED : May 26, 1998
INVENTOR(S) : Yutaka Yamamoto et al.

It is certified that error appears in the above-identified patent and that said Letters Patent is hereby corrected as shown below:

On the title page, item [57], replace "$40 \leq a < 80$," with --$40 \leq a \leq 80$,--.

Column 12, line 20,
claim 1, line 10, replace "In,Sn," with --In, Sn,--.

Signed and Sealed this
Nineteenth Day of January, 1999

*Attest:*

*Attesting Officer*

*Acting Commissioner of Patents and Trademarks*